US006924007B2

(12) United States Patent
Browning

(10) Patent No.: US 6,924,007 B2
(45) Date of Patent: Aug. 2, 2005

(54) HVOF WIRE SPRAY SYSTEM

(76) Inventor: James Browning, P.O. Box 6, Hanover, NH (US) 03755

( * ) Notice: Subject to any disclaimer, the term of this patent is extended or adjusted under 35 U.S.C. 154(b) by 0 days.

(21) Appl. No.: 10/436,236

(22) Filed: May 13, 2003

(65) Prior Publication Data

US 2004/0228979 A1 Nov. 18, 2004

(51) Int. Cl.[7] ..... B05D 1/08; C23C 4/12
(52) U.S. Cl. ..... 427/449; 239/83; 239/84
(58) Field of Search ..... 427/449; 239/83, 239/84; 118/302

(56) References Cited

U.S. PATENT DOCUMENTS 4,593,856 A * 6/1986 Browning ..... 239/83

5,614,022 A * 3/1997 Vatavuk et al. ..... 118/302

* cited by examiner

*Primary Examiner*—Katherine Bareford
(74) *Attorney, Agent, or Firm*—Sughrue Mion, PLLC

(57) ABSTRACT

In a thermal spray process, a wire is fed into a flame-jet to heat said wire to the melting point, atomize and projected high velocity the droplets so formed against a surface to buildup a coating of material on the surface. The wire is fed into the flame by aligning the cast-plane of the wire with the flame-jet by using a tubular member formed into a circular shape to provide sufficient length to guide wire and to provide the necessary twist amount to the wire to align the cast-plane with the axis of the flame-jet.

5 Claims, 2 Drawing Sheets

HVOF WIRE SPRAY SYSTEM

BACKGROUND OF THE INVENTION

FIELD OF THE INVENTION

In studying methods to improve HVOF (High Velocity Oxy-Fuel) use for spraying wire, in place of or together with powder, it was discovered that using straight wire, which would seem to be the obvious choice, could not be used in a practical manner. The preferred choice of spray wire, as in welding applications, is wire tightly wound on spools of one to two feet in diameter. The wire, in the wind-on process is mechanically strained into a circular loop shape from about 18 inches to 2 feet. This diameter is called the "cast". It is simply measured by cutting a short length from the spool, laying it on the floor and measuring the diameter.

In trying to straighten this curved wire it was found that in most cases this was easily done, but that the straight wire would not pas axially along the axis of the supersonic flame-jet. It would, probably due to the intense heating, take a set and curve away from the flame. The purpose of a long wire path within the flame is to assure high melt-off rates to maximize spray rates.

SUMMARY OF THE INVENTION

The same wire without straightening, that is with its natural cast, does not show this thermal-set action. The wire, until it becomes red hot holds its cast while passing through the jet. The essence of this invention is to use feed wire with its normal cast and to position the plane of the cast to that in which the flame-jet gases flow.

BRIEF DESCRIPTION OF THE DRAWINGS

The mechanism for producing such cast alignment will become evident from the figures, where.

DETAILED DESCRIPTION OF PREFERRED EMBODIMENTS

Figure 1:
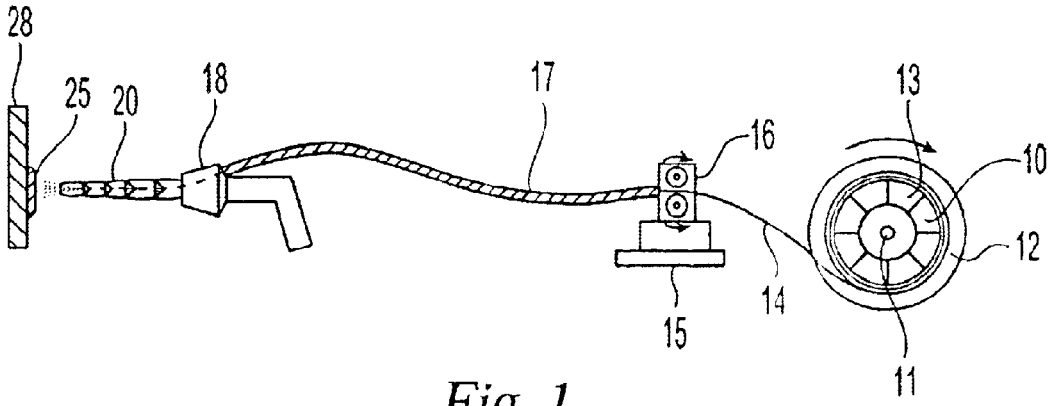
FIG. 1 is a side view of a typical HVOF wire spray system with the vertical plane of the cast including the flame-jet.
Figure 2:
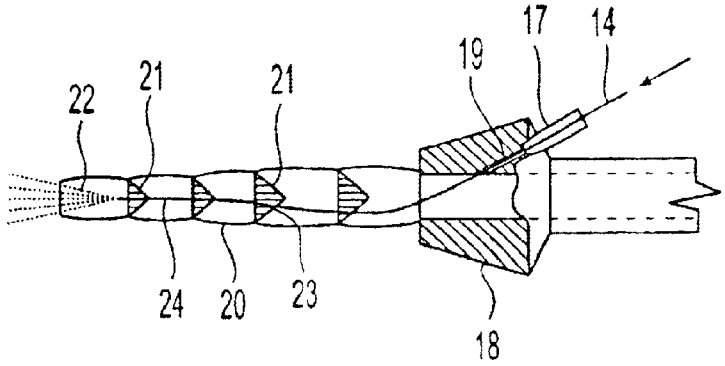
FIG. 2 is an enlarged view of the wire being fed through the gun into the flame-jet.

FIG. 1 shows a long length of wire 14 wound tightly on a spool 10. Such spools usually consist of spokes 13 holding a U-shaped annular frame 12. Wire 14 is pulled from spool 10 by a wire-feeder 15 using drive wheels 16 as spool 10 rotates on axle 11. The cast of wire 14 is positive in FIG. 1. The pulling force of drive wheels 16 temporarily eliminates cast curvature. However, when this force no longer acts, the cast reappears. Wire 14 is constrained by a curved duct-lead 17 passing from drive unit 15 to gun 18. The duct 17 provides a curved path leading to the flame jet. Again, guide hole 19 constrains wire 14 to a straight path to the terminal face of gun 18 at which release point the cast reappears as shown by path 23 in FIG. 2. Immediately beyond gun 18 the wire 14 passes into and along supersonic jet 20 characterized by shock diamonds 21. Wire heating is intense and when it reaches position 24 bends into a more axial position within the flame. Atomization at 21 occurs with spray droplets accelerated toward the workpiece 28 to impact 28 and to form a deposit 25.

Figure 3:
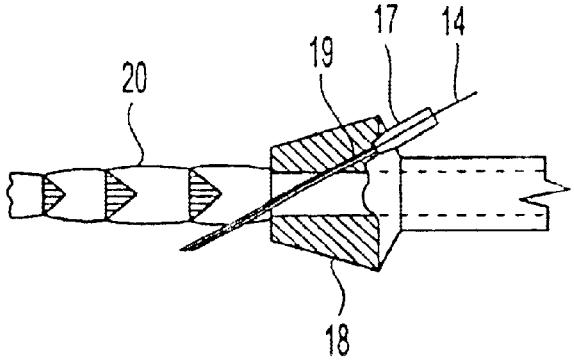
FIG. 3 is a top view of the flame-jet portion of the set-up of FIG. 1, except with the gun rotated 90 degrees clockwise.

The cast, unless a twisting moment is applied to it, will remain in its vertical position as shown in FIG. 1. For any other entry point into gun 18, the wire will still rise vertically when leaving the gun. Assume the gun to be rotated 90 degrees clockwise, as in hand-held spraying. The new position is shown in FIG. 3. Wire 14 passes with a radial component through flame-jet 20 exposing itself to a short dwell time within the flame.

Figure 4:
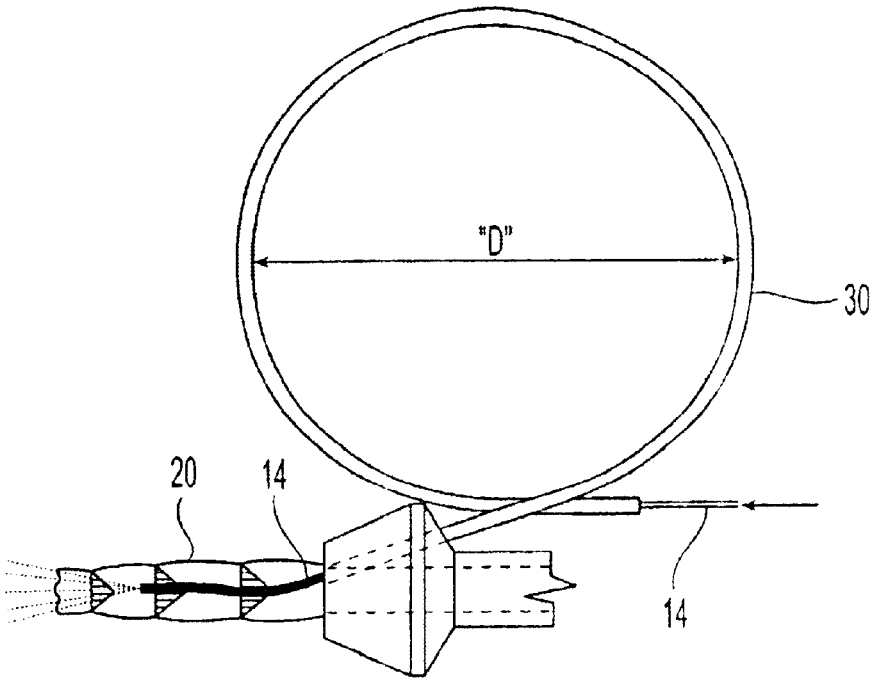
FIG. 4 shows one means to rotate the cast plane to contain the flame-jet.

Unless the cast is aligned with jet 20, an unfavorable heating results for all positions other than the vertical "on-top" case of FIG. 1. A solution to this problem is shown in FIG. 4. A loop of tubing 30 causes a nearly 360 degree change of direction for wire 14. This path follows loop 30 which is aligned with flame-jet 20. If the natural cast of wire 14 is suitable for the process, diameter "D" of loop 30 is made to approximate the cast. Loop 30 twists wire 14 by an amount which causes the initial cast to rotate into the plane defined by the loop 30. Thus, for entry into gun 18 90 degrees clockwise from vertical, the loop plane should be about horizontal. Additionally, if the cast itself should be made smaller the diameter of the loop 30 should be reduced. If the cast of the wire should be made larger, the diameter of the loop is increased. Thus, the wire cast can be reduced by making the diameter of the loop 30 less than that of the natural cast of the wire 14 entering the loop 30, or the loop 30 can increase cast by selecting a loop 30 with a diameter greater than the natural cast of wire 14 entering the loop 30. When the entry to gun 18 is on the bottom (180 degrees from that of FIG. 1), the cast is positioned properly by loop 30 to the required negative curvature. In such manner, multiple wires using multiple loops 30 may be positioned in parallel in alignment with the axis of the flame jet around gun 18. Each wire passes nearly axially along flame-jet 20. The multiple wires can be angled into the flame-jet 20 from multiple points around the circumference of the flame-jet 20 by providing the necessary twist to each wire 14 to align the plane containing the curved path with the flame-jet axis 20.

This invention covers means for twisting wire 14 by an amount required to align the cast-plane to that of flame-jet 20. It is most useful for hand-held operation where gun 18 is moved into many different positions. Of course, when gun 18 is in a fixed position, one wire entry position in-line with spool 10 will provide the proper cast alignment.

What is claimed is:

1. In a thermal spray process including feeding wire to be sprayed into and along a flame-jet to heat said wire to the melting point, atomize and project at high velocity the droplets so formed against a surface to build up a coating of material on said surface, the improvement comprising feeding said wire at an angle into said flame-jet using an non-straight wire having a cast by creating a curved path leading into said flame-jet, wherein multiple wires are fed into and through said flame-jet from a wire feed system so-positioned to provide that the planes containing said curved paths are arranged in-parallel in alignment with the axis of said flame-jet.

2. In a thermal spray process as set forth in claim 1 wherein said multiple wires are angled into said flame-jet axis from multiple points around the circumference of said flame-jet by providing the necessary twist to each wire to align the plane containing said curved path with said flame-jet axis.

3. In a thermal spray process including feeding wire to be sprayed into and along a flame-jet to heat said wire to the melting point, atomize, and project at high velocity the droplets so formed against a surface to build up a coating of material on said surface, the improvement comprising feeding said wire at an angle into said flame-jet using a non-straight wire having a cast by creating a curved path leading into said flame-jet, comprising providing a cast-alignment device to effect the necessary twisting of the wire to allow alignment of the plane containing said curved path with the axis of said flame-jet, comprising providing a cast-alignment device to effect the necessary twisting of the wire to allow alignment of the plane containing said curved path with the axis of said flame-jet, wherein said device to align the plane containing said curved path with the flame-jet axis is comprised of a tubular element formed into a circular shape of sufficient length to guide said wire and to provide the necessary twist amount to said wire to align the plane containing said curved path with the axis of said flame-jet.

4. In a thermal spray process as set forth in claim 3, wherein said tubular element reduces the selecting a the path said tubular element to be less than that of the natural cast of said wire entering said tubular element.

5. In a thermal spray process as set forth in claim 3, wherein said tubular element increases cast by selecting a tubular element path diameter greater than the natural cast of said wire to effect a larger cast of said wire.

* * * * *